US008535028B2

(12) United States Patent
Groves

(10) Patent No.: US 8,535,028 B2
(45) Date of Patent: Sep. 17, 2013

(54) DOWNHOLE POSITIVE DISPLACEMENT MOTOR

(75) Inventor: William Emil Groves, Calgary (CA)

(73) Assignee: Cansonics Inc., Calgary, Alberta (CA)

( * ) Notice: Subject to any disclaimer, the term of this patent is extended or adjusted under 35 U.S.C. 154(b) by 341 days.

(21) Appl. No.: 13/039,019

(22) Filed: Mar. 2, 2011

(65) Prior Publication Data

US 2011/0217199 A1 Sep. 8, 2011

Related U.S. Application Data

(60) Provisional application No. 61/309,720, filed on Mar. 2, 2010.

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/48; 418/181; 418/270; 175/107; 166/104

(58) Field of Classification Search
USPC ..... 418/48, 61.3, 181, 270; 175/107; 166/104
See application file for complete search history.

(56) References Cited

U.S. PATENT DOCUMENTS

| | | | | |
|---|---|---|---|---|
| 5,320,500 | A | 6/1994 | Cholet | |
| 6,004,114 | A | 12/1999 | Cunningham et al. | |
| 6,279,670 | B1 * | 8/2001 | Eddison et al. | 175/107 |
| 6,289,998 | B1 * | 9/2001 | Krueger et al. | 175/107 |
| 2008/0029268 | A1 * | 2/2008 | Macfarlane | 166/316 |
| 2009/0139769 | A1 * | 6/2009 | Traylor | 175/57 |
| 2009/0223676 | A1 * | 9/2009 | Eddison et al. | 175/107 |
| 2011/0073374 | A1 * | 3/2011 | Bunney et al. | 175/107 |

* cited by examiner

*Primary Examiner* — Theresa Trieu
(74) *Attorney, Agent, or Firm* — Bennett Jones LLP

(57) ABSTRACT

A downhole positive displacement motor converts hydraulic fluid pressure into rotational torque. The motor includes a non-helical rotor and stator, and upper and lower valve assemblies each comprising cylindrical rotating and stationary elements which define longitudinal passages. The timing of alignment of the passages creates pressure in power pockets in the stator, rotating the rotor. The rotational torque can be used in any application that may require mechanical force to operate or drive a mechanism created for oil, gas, or water production in a down hole application.

5 Claims, 3 Drawing Sheets

FIG. 2
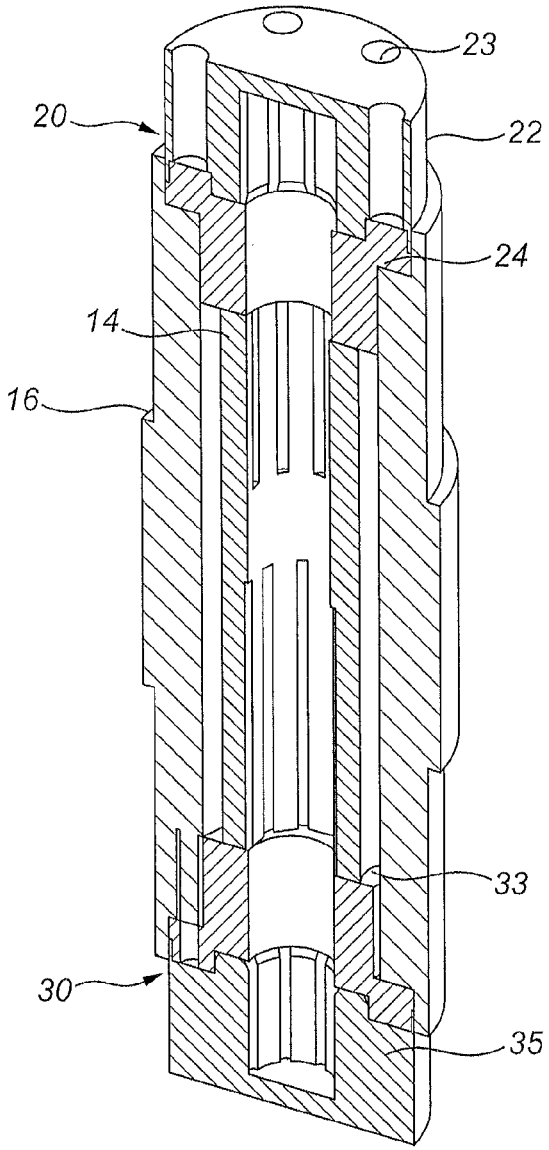
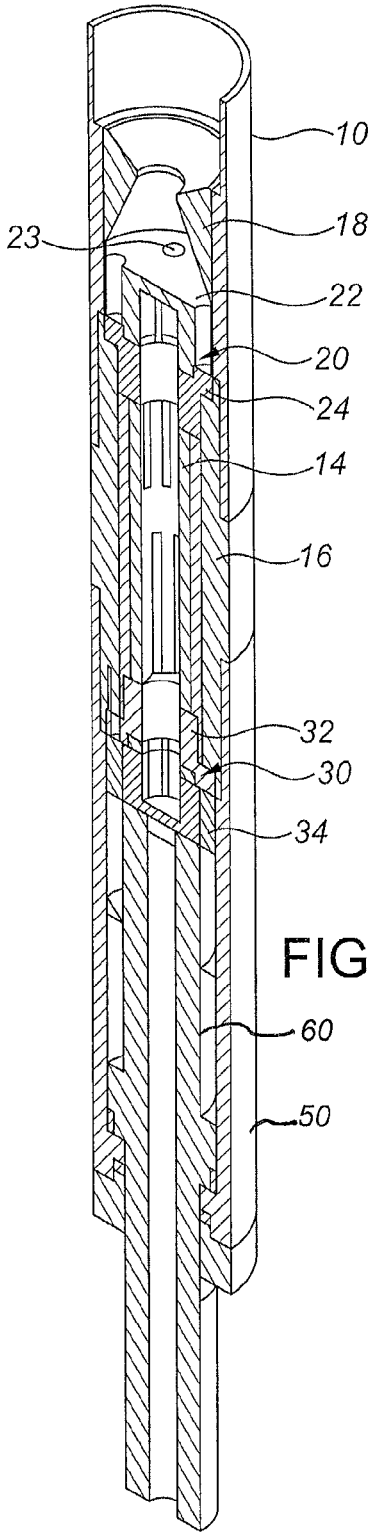
FIG. 1

DOWNHOLE POSITIVE DISPLACEMENT MOTOR

FIELD OF THE INVENTION

The present invention is directed to a downhole motor for use with production systems in oil and gas wells.

BACKGROUND

Positive displacement motors (motors) are well known in the art, and are primarily used to drive drill bits in directional drilling motors. Such motors are colloquially known as "mud motors" as they rely on a pressurized flow of drilling mud or fluid to drive them. Such motors operate pursuant to the Moineau principle and are also known as progressive cavity motors. The power section of a positive displacement motor (motor) converts the hydraulic energy of high pressure drilling fluid to mechanical energy in the form of torque output for the drill bit. A power section consists of a helical-shaped rotor and stator. The rotor has a number of helical lobes, and is typically made of steel and is either chrome plated or coated for wear resistance. The stator is a heat-treated steel tube lined with a helical-shaped elastomeric insert. The rotors have one less lobe than the stators and when the two are assembled, a series of cavities is formed along the helical curve of the power section. Each of the cavities is sealed from adjacent cavities by seal lines formed along the contact line between the rotor and stator, which are critical to power section performance.

High pressure fluid is pumped into one end of the power section, where it fills the first set of open cavities. The pressure differential across two different cavities causes the rotor to turn. This filling and rotation process repeats in a continuous manner as long as high pressure fluid is being delivered to the power section.

Slip is caused when high pressure fluid blows by the rotor and stator seal lines, resulting in power section speed reduction. During downhole operation, differential pressure and slip increase and the load on bit increases. Many factors affect slip, and finding an optimal fit between rotor and stator is critical to balance stator life and slip efficiency. Power section failures are primarily due to destruction of the stator elastomer.

A typical positive displacement motor requires a large volume of high pressure fluid, and is therefore very inefficient if used in a production setting, as opposed to a drilling operation.

SUMMARY OF THE INVENTION

The present invention comprises a novel positive displacement motor for downhole use. In particular, the motor may be used to power downhole pumps in a producing oil and gas well. In general terms, the motor uses a non-helical stator and rotor, where the rotor rotates eccentrically within the stator. Upper and lower valve assemblies are timed to create sequential pulses of high pressure fluid through stator which operates to rotate the rotor.

In one aspect, the motor comprises:

(a) an upper cylindrical housing having a connection adapted to connect to a hydraulic fluid source, and defining a central bore;

(b) an upper valve assembly disposed within the upper housing, comprising a rotating cylindrical valve defining a plurality of longitudinal inlet passages numbering x, and a stationary cylindrical valve adjacent the rotating valve and defining a plurality of longitudinal transfer passages numbering x+1, configured such that when one inlet passage is wholly aligned with a transfer passage, at least one other inlet passage is partially aligned with another transfer passage;

(c) a stator defining an internal passage having a plurality of lobe openings equal to x+1, which lobe openings are aligned with the longitudinal passages of the upper stationary valve;

(d) a rotor comprising x lobes disposed within the stator, the rotor being eccentrically rotatable within the stator;

(e) a lower valve assembly comprising a lower stationary cylindrical valve adjacent the rotor and defining a plurality of longitudinal transfer passages numbering x+1, and a lower rotating cylindrical valve defining a plurality of longitudinal exhaust passages numbering x, configured such that one lower exhaust passage is wholly aligned with a lower transfer passage, at least one lower exhaust passage is partially aligned with a lower transfer passage;

(f) wherein the rotor and stator are disposed between the upper stationary valve and the lower stationary valve, and define a plurality of power pockets between the rotor and stator as the rotor rotates within the stator;

(g) an upper drive mechanism connected to the rotor for rotating the upper rotating valve, and a lower drive mechanism connected to the rotor for rotating the lower rotating valve; and (h) a drive mechanism connected to the rotor or the lower rotating valve for driving a downhole tool.

In operation, hydraulic fluid enters the housing and the upper valve assembly. In the upper valve assembly, it is forced through an aligned upper inlet passage and a transfer passage, and into a power pocket. Fluid pressure within the power pocket rotates the rotor. The lower valve assembly then rotates to align a lower transfer passage and a lower exhaust passage with the power pocket, allowing fluid to escape. The upper valve assembly rotates to align the next upper inlet passage and transfer passage, which then pressurizes the next power pocket formed by rotation of the rotor within the stator. The alignment of inlet and transfer passages in the upper valve assembly rotates so that the power pocket which is being pressurized rotates from passage to passage in the stator. Alignment of the transfer and exhaust passages in the lower valve assembly is timed to allow pressure to build in the power pocket, and then release the fluid.

In an alternative embodiment, the rotating and stationary valve elements are reversed, such that the stationary valves define x passages, and the rotating valves define x+1 passages.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows:

FIG. 1 is a longitudinal cross-sectional view of one embodiment of the invention.

FIG. 2 is a cross-sectional view of one embodiment, showing power fluid flow through a power pocket formed between the rotor and the stator.

DETAILED DESCRIPTION OF PREFERRED EMBODIMENTS

Figure 3A:
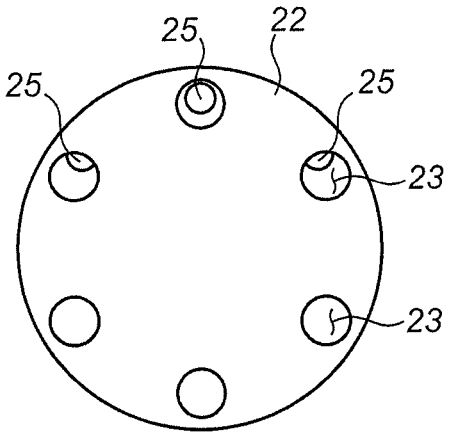
FIG. 3A shows a view of the upper valve assembly, with one longitudinal passage of the rotating valve wholly aligned with one transfer passage.

The invention relates to a positive displacement motor. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

The terms "upper" and "lower" refer to the configuration of the motor in normal use, in a vertical or near-vertical wellbore. For greater certainty, fluid flow through the motor enters the upper end of the motor, and exits the lower end. The character of the hydraulic fluid used to power the motor is not essential, and may be a liquid or a gas.

In general terms, the invention comprises an apparatus, one embodiment of which is shown in the Figures. FIG. 1 shows a longitudinal cross-section showing the major components of the apparatus. An elongate cylindrical housing (10) defines a central bore and an upper end adapted to be connected to tubing or piping, which is adapted to deliver hydraulic fluid under pressure. Disposed within the housing are an upper valve assembly (20), a rotor (14) and a stator (16), and a lower valve assembly (30). Pressurized hydraulic fluid flowing through the apparatus causes rotation of the rotor (14) in the manner described below. The rotor (14) is connected to a drive mechanism (60) which is attached to the tool or apparatus (not shown) which is rotated by the motor. In one embodiment, a fluid accelerator (18) provides for smoother fluid flow into the upper valve assembly (20).

The elements of the apparatus may be metal on metal construction, or may use various high density plastics as is well known in the art. Because there are elements of the apparatus which are rotating, adjacent surfaces may be highly polished and/or lubricated to reduce friction. Low-friction materials may be preferred. Suitable bearings, bushings and seals not shown or described will be used where suitable or necessary, as one skilled in the art will appreciate.

The upper valve assembly (20) comprises an upper rotating valve (22) which defines a plurality of longitudinal inlet passages (23) and an upper stationary valve (24) which defines a plurality of longitudinal transfer passages (25). If the number of inlet passages=x, then the number of transfer passages=x+1. In one embodiment, x=6. In an alternative embodiment, x=4. Each of the inlet and transfer passages are spaced equidistantly about the circumference of the valves (22, 24). Thus, when one inlet passage is completely aligned with a transfer passage, then it may be seen that the adjacent inlet passages are partly aligned with an adjacent transfer passage.

Figure 4:
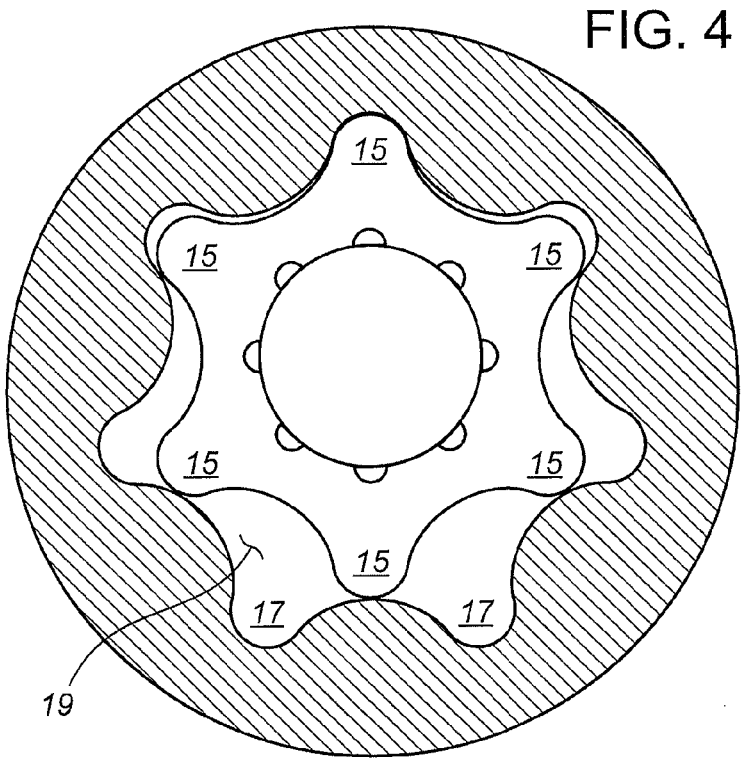
FIG. 4 shows a transverse cross-section of the rotor and stator.
Figure 5:
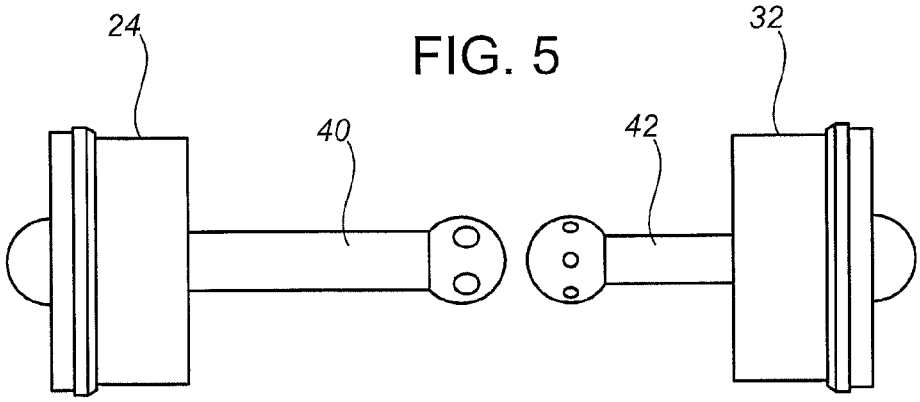
FIG. 5 shows dog-leg connectors for driving the upper rotating valve and the lower rotating valve.

The rotor (14) comprises x number of lobes (15), equal to the number of inlet passages in the upper valve assembly. The stator (16) defines x+1 lobe openings (17) which have a shape corresponding to the rotor lobes (15). As may be seen in FIG. 4, the rotor (14) may eccentrically rotate within the stator (16), creating power pockets (19) between the rotor and the stator as it rotates.

The lower valve assembly (30) is a mirror image of the upper valve assembly (20). The lower stationary valve (32) is identical to the upper stationary valve (24) in that it defines x+1 number of passages (33). Similarly, the lower rotating valve (34) is identical to the upper rotating valve in that it defines x number of passages (35).

Figure 3B:
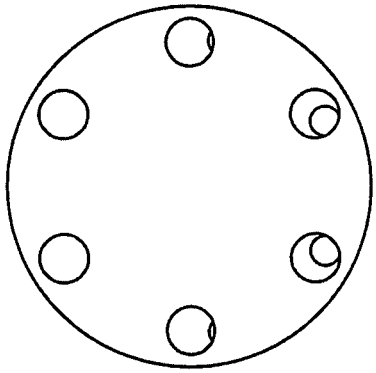
FIGS. 3B and 3C show the same view as the rotating valve and the stationary valve rotate relative to each other.
Figure 3C:
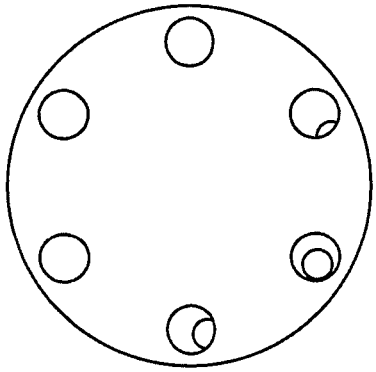

In the sequence shown in FIGS. 3A-C, the upper rotating valve (22) is rotating counter-clockwise relative to the stationary valve (24) below it. In FIG. 3A, the inlet (23) and transfer (25) passages at the 12 o'clock position are aligned and therefore fully open, and the passages at the approximately 10 o'clock position is closing, while the passages at the approximately 2 o'clock position is opening. In this position, a power pocket aligned at the 12 o'clock position would receive a charge of pressurized fluid. Rotation of the lower rotating valve relative to the lower stationary valve results in the same rotation of alignment as seen in FIGS. 3A-C. However, the timing of alignment of passages in the lower valve assembly is offset from the timing of alignment in the upper valve assembly. When the upper valve assembly is in the position shown in FIG. 3A, the lower valve assembly (30) would be closed in this position, such that the fluid pressure is directed to rotating the rotor. Adjacent lobe openings (17) would be open or partially open through the lower valve assembly, allowing fluid to drain from the lobe opening (17). Thus, pressure in the active power pocket is always higher than in the adjacent lobe openings (17). In FIG. 2-3B, the passages at the adjacent position (approximately 2 o'clock) and the next adjacent position (approximately 4 o'clock position) are open the same amount, but the former is closing, while the latter is opening.

At any given time, at least two inlet passages are fully closed, and when an inlet passage and a transfer passage are completely aligned, then three inlet passages are fully closed (see FIG. 3A).

As will be appreciated by one skilled in the art, rotation of the upper and lower valve assemblies and the rotor will create varying flow paths for the hydraulic fluid, resulting in the application of fluid pressure in power pockets. The x+1 lobe openings (17) are fixed in position and aligned with the transfer passages of the upper valve assembly (20) and the transfer passages of the lower valve assembly. As the rotor rotates, the power pocket being pressurized similarly rotates. Proper timing of the rotational elements is of course essential to creating pressurized power pockets at the right time and in the right order. Timing and rotational actuation is accomplished by an upper drive assembly (42) and a lower drive assembly (40). In one embodiment, the upper and lower drive assemblies comprise "dog bone" connectors (42, 40) which accommodate the eccentric rotation of the rotor (14). The dog bones (40, 42) are keyed to internal passages in the rotor (14), the upper rotating valve (22) and the lower rotating valve (34).

In an alternative embodiment, the rotating and stationary valve elements are reversed, such that the stationary valves define x passages, and the rotating valves define x+1 passages.

Fluid exiting the lower valve assembly (30) may be returned to the surface in a separate fluid return line or after mixing with production fluids in well bore, in an annulus or microannulus.

A lower cylindrical housing (50) encloses the lower portion of the stator (16) and the lower valve assembly (30), and the drive assembly (60). The drive shaft may be connected directly to the rotor (14), or indirectly to the lower rotating valve (34).

The motor of the present invention may be used in various drilling, production, milling, stimulation or other downhole operations where rotary power may be useful.

As will be apparent to those skilled in the art, various modifications, adaptations and variations of the foregoing specific disclosure can be made without departing from the scope of the invention claimed herein.

What is claimed is:

1. A downhole positive displacement motor comprising:

(a) an upper cylindrical housing having a connection adapted to connect to a hydraulic fluid source, and defining a central bore;

(b) an upper valve assembly disposed within the upper housing, comprising a rotating cylindrical valve defining a plurality of longitudinal inlet passages numbering x, and a stationary cylindrical valve adjacent the rotating valve and defining a plurality of longitudinal transfer passages numbering x+1, configured such that when one inlet passage is wholly aligned with a transfer passage, at least one other inlet passage is partially aligned with another transfer passage;

(c) a stator defining an internal passage having a plurality of lobe openings equal to x+1, which lobe openings are aligned with the longitudinal passages of the upper stationary valve;

(d) a rotor comprising x lobes disposed within the stator, the rotor being eccentrically rotatable within the stator;

(e) a lower valve assembly comprising a lower stationary cylindrical valve adjacent the rotor and defining a plurality of longitudinal transfer passages numbering x+1, and a lower rotating cylindrical valve defining a plurality of longitudinal exhaust passages numbering x, configured such that one lower exhaust passage is wholly aligned with a lower transfer passage, at least one lower exhaust passage is partially aligned with a lower transfer passage;

(f) wherein the rotor and stator are disposed between the upper stationary valve and the lower stationary valve, and define a plurality of power pockets between the rotor and stator as the rotor rotates within the stator;

(g) an upper drive mechanism connected to the rotor for rotating the upper rotating valve, and a lower drive mechanism connected to the rotor for rotating the lower rotating valve; and (h) a drive mechanism connected to the rotor or the lower rotating valve for driving a downhole tool.

2. The motor of claim 1 wherein x=4 or x=6.

3. The motor of claim 1 further comprising a fluid accelerator disposed in the upper housing, above the upper valve assembly.

4. The motor of claim 1 wherein the upper rotating valve is disposed above the upper stationary valve.

5. The motor of claim 1 wherein the lower rotating valve is disposed below the lower stationary valve.

* * * * *